US007891663B2

(12) United States Patent
Tsuruoka

(10) Patent No.: US 7,891,663 B2
(45) Date of Patent: Feb. 22, 2011

(54) OVERLAPPED CONVEYANCE DETECTION APPARATUS FOR PRINTING SHEET

(75) Inventor: Hiroyuki Tsuruoka, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 370 days.

(21) Appl. No.: 12/052,851

(22) Filed: Mar. 21, 2008

(65) Prior Publication Data

US 2009/0085284 A1 Apr. 2, 2009

(30) Foreign Application Priority Data

Oct. 1, 2007 (JP) ..... 2007-257120

(51) Int. Cl.
*B65H 7/02* (2006.01)

(52) U.S. Cl. ..... 271/265.04; 271/265.02; 271/262; 271/259

(58) Field of Classification Search ..... 271/265.01, 271/265.02, 265.04, 262, 259
See application file for complete search history.

(56) References Cited

U.S. PATENT DOCUMENTS 7,526,969 B2 * 5/2009 Schoen ..... 73/865.8
2001/0042956 A1 * 11/2001 Minoru et al. ..... 271/265.04
2004/0150155 A1 * 8/2004 Okitsu et al. ..... 271/262
2008/0036139 A1 * 2/2008 Reyner et al. ..... 271/262

FOREIGN PATENT DOCUMENTS

| | | |
|---|---|---|
| JP | 2006106877 | 4/2006 |
| JP | 2006139582 | 6/2006 |
| JP | 2006248701 | 9/2006 |
| JP | 2006330459 | 12/2006 |

OTHER PUBLICATIONS

Japanese Notice of Grounds for Rejection and English translation thereof, mailed on Jan. 26, 2010 relating to Japanese Patent Application No. 2007-257120.

* cited by examiner

*Primary Examiner*—Stefanos Karmis
*Assistant Examiner*—Howard Sanders
(74) *Attorney, Agent, or Firm*—Gauthier & Connors LLP

(57) ABSTRACT

In an apparatus which detects overlapped conveyance of a printing sheet using ultrasonic wave attenuation, when a printing sheet with an IC tag is conveyed, the position of the IC tag on the printing sheet is acquired. By reference to the acquired IC tag position, overlapped conveyance detection is performed at a position which is not under the influence of the IC tag.

8 Claims, 4 Drawing Sheets

OVERLAPPED CONVEYANCE DETECTION APPARATUS FOR PRINTING SHEET

CROSS-REFERENCE TO RELATED APPLICATIONS

This application is based on and claims priority under 35 USC 119 from Japanese Patent Application No. 2007-257120 filed on Oct. 1, 2007.

BACKGROUND

1. Technical Field

The present invention relates to an apparatus that detects overlapped conveyance in which printing sheets are conveyed in an overlapped manner.

2. Related Art

In recent years, there has been put into practice use of RFID (Radio Frequency Identification) technology, which performs non-contact communication with an IC (Integrated Circuit) tag provided with a communication antenna and an IC chip allowing writing or reading of information. Printing sheets incorporating such IC tag are also known; for example, the information written on the surface of the printing sheet or information of other types is stored in the IC tag.

An apparatus, such as a copier and printer, which forms an image on a printing sheet may include an overlapped conveyance detection apparatus which monitors whether printing sheets are being conveyed one after the other; i.e., whether printing sheets are being conveyed in a non-overlapped manner. The overlapped conveyance detection apparatus transmits ultrasonic waves to a printing sheet so that the printing sheet is vibrated by the ultrasonic waves, and detects overlapped conveyance based on attenuation of the ultrasonic waves in the secondary vibration.

An aerial layer is formed in that part of the printing sheet into which the IC tag is incorporated; thus, the attenuation of the ultrasonic waves is larger in that part, possibly leading to erroneous detection of overlapped conveyance.

An advantage of the present invention is to provide an overlapped conveyance detection apparatus using ultrasonic waves, the apparatus being compatible with a printing sheet incorporating an IC tag.

SUMMARY

According to the present invention, there is provided an overlapped conveyance detection apparatus which detects overlapped conveyance of a printing sheet incorporating an IC tag, the apparatus including: an overlapped conveyance detection unit that transmits and receives ultrasonic waves to/from the printing sheet and detects overlapped conveyance of the printing sheet based on an ultrasonic wave signal; a tag position information acquisition unit that acquires the position of at least one IC tag on the printing sheet; and a detection prohibition area determination unit that determines, by reference to the acquired IC tag position, an area on the printing sheet in which overlapped conveyance detection is prohibited.

BRIEF DESCRIPTION OF THE DRAWING

Exemplary embodiments of the present invention will be described in detail by reference to the following figures, wherein.

DETAILED DESCRIPTION

Figure 1:
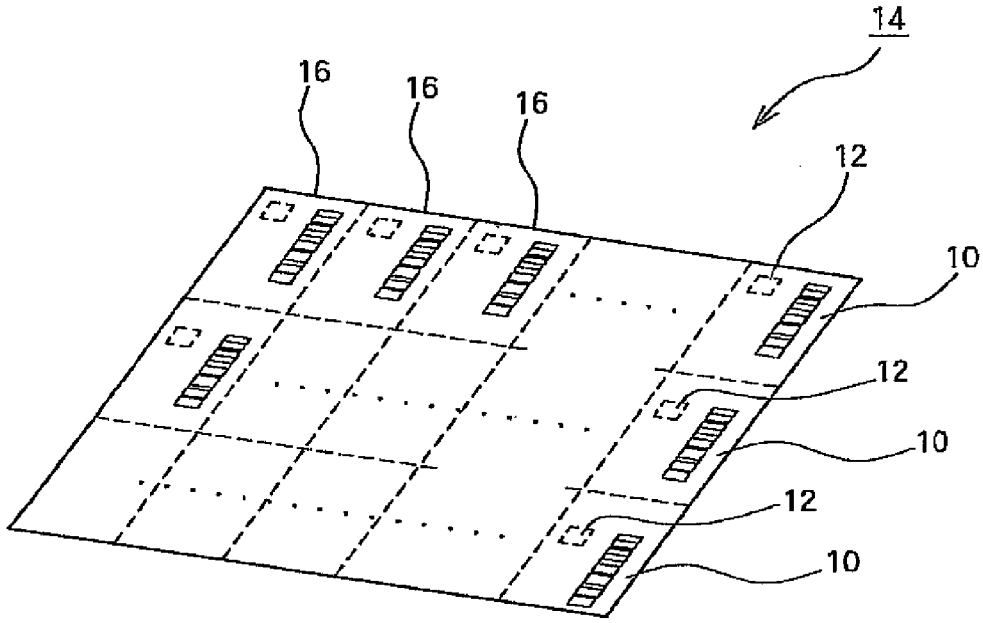
FIG. 1 is a view schematically illustrating a bar code label sheet.

Exemplary embodiments of the present invention will be described below with reference to the drawings. FIG. 1 is a view illustrating a bar code label sheet (hereinafter referred to as a "label sheet") 14 having a bar code 10 printed on the surface thereof and further having an IC tag 12 incorporated therein. One sheet contains multiple labels 16; one IC tag 12 is incorporated for each label 16; one bar code 10 is printed for each label 16. The IC tag 12 is put into the sheet during production of the sheet so as to be hidden from the outside.

Figure 2:
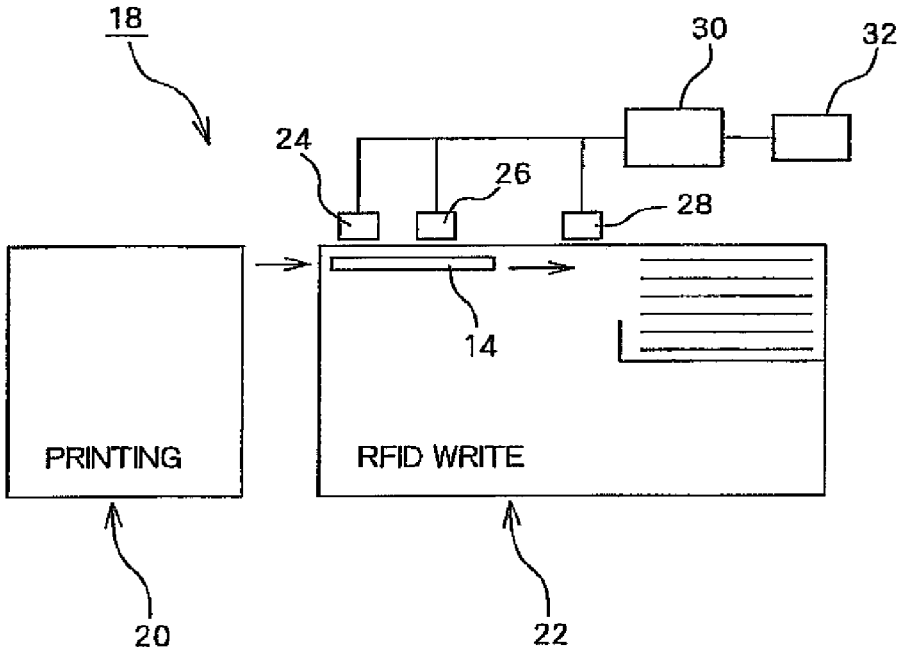
FIG. 2 is a schematic configuration diagram of a printer for a bar code label sheet incorporating an IC tag.

FIG. 2 is a view illustrating a schematic configuration of a printer 18 for the label sheet 14 which prints a bar code on the label sheet 14 and also supplies information to the IC tag 12. The printer 18 includes a printing unit 20 which prints the bar code 10, and an RFID write unit 22 which writes information corresponding to the bar code 10 into the IC tag 12. In the RFID write unit 22, the bar code 10 printed by the printing unit 20 is read by means of a bar code reader 24, and information corresponding to the read bar code is written by means of an RFID reader/writer 26. There is further included an overlapped conveyance sensor 28 which monitors overlapped conveyance of the label sheet 14. The bar code reader 24, RFID reader/writer 26, and overlapped conveyance sensor 28 are controlled by a controller 30 in synchronization with each other. Also, the controller 30 includes an input unit 32 which receives predetermined information from the outside. The input unit 32 may be, for example, an operation panel provided with a switch operated by the operator, a keyboard or the like, an interface for connection to an external apparatus, or a read apparatus which reads information from a predetermined recording medium.

Figure 3:
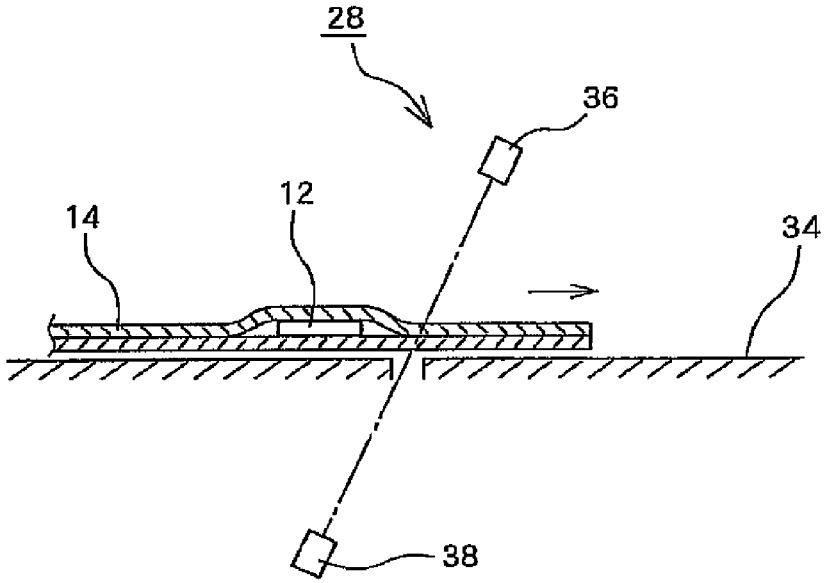
FIG. 3 is a view illustrating a configuration of an overlapped conveyance sensor.

FIG. 3 is a view illustrating a schematic configuration of the overlapped conveyance sensor 28. The label sheet 14 is conveyed on a sheet conveyance path 34 while driven by a roller or the like (not illustrated). As illustrated in FIG. 3, the IC tag 12 is incorporated in the label sheet 14 in a manner sandwiched between two pieces of sheets. In the IC tag 12 and its vicinity, an aerial layer exists inside the single sheet. On the sheet conveyance path 34, an ultrasonic wave transmitter 36 and ultrasonic wave receiver 38 constituting the overlapped conveyance sensor 28 are arranged to sandwich the sheet conveyance path 34. The ultrasonic waves transmitted from the ultrasonic wave transmitter 36 are attenuated by a material lying between the ultrasonic wave transmitter 36 and ultrasonic wave receiver 38 and then received by the ultrasonic wave receiver 38. In the ultrasonic wave receiver 38, the received ultrasonic wave signal is converted into an electric signal and then amplified and sent to the controller 30. The controller 30 determines, from the signal sent from the overlapped conveyance sensor 28, whether or not overlapped conveyance has occurred. When the label sheet 14 is conveyed, the overlapped conveyance sensor 28 scans the entire length of the label sheet 14 along the conveyance direction with ultrasonic waves; and the controller 30 monitors overlapped conveyance on the basis of the scanning result.

When the printing sheet is conveyed in an overlapped manner, an aerial layer lies between the printing sheets; thus, the transmitted ultrasonic waves pass through the first sheet, the aerial layer, and the second sheet in this order. Since the aerial layer lies therebetween, the ultrasonic waves are attenuated twice. When overlapped conveyance occurs, the ultrasonic waves are more attenuated than when one piece of printing sheet is normally conveyed; based on this, the overlapped conveyance detection is performed. When the label sheet 14 is conveyed, since an aerial layer lies in the IC tag 12 part, there occurs a state similar to an overlapped conveyance state. More specifically, while no overlapped conveyance occurs, overlapped conveyance may be detected in the IC tag 12 and its vicinity.

Figure 4:
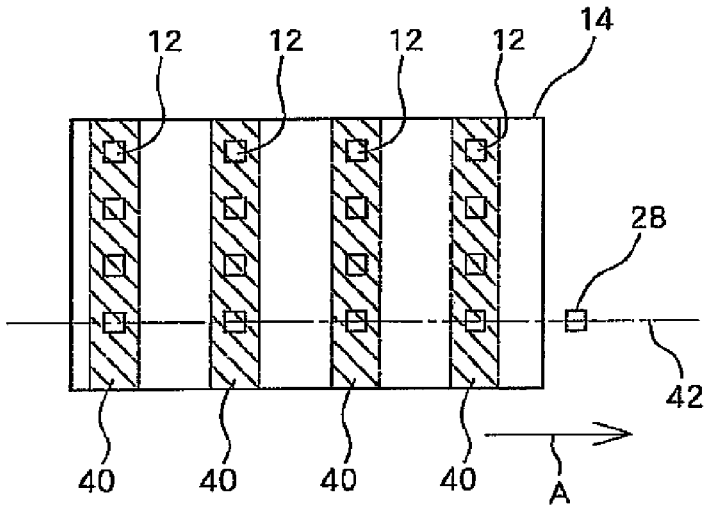
FIG. 4 is a view illustrating an exemplary overlapped conveyance detection prohibition area.

The controller 30 excludes, from the area to be monitored for overlapped conveyance, an area in which erroneous detection of overlapped conveyance may occur. FIG. 4 is a view of the label sheet 14 as seen from above. In FIG. 4, the conveyance direction is indicated by the arrow A. The position of the label sheet 14 on the sheet conveyance path is monitored at all times by the controller 30 by means of one or more edge sensors (not illustrated) arranged on the path, by reference to the rotating speed of the conveyance roller and the like. More specifically, when the edge of the label sheet 14 is detected by the edge sensor, the position of the label sheet 14 at a given time is perceived by reference to the detected edge position and the sheet conveyance speed implemented by the conveyance roller. When information is written into the IC tag 12 by the RFID reader/writer 26, the RFID reader/writer 26 is positioned opposite the IC tag 12. From this information, the controller 30 identifies the position of the IC tag 12 on the label sheet 14. An overlapped conveyance detection prohibition area is set at the IC tag 12 and its vicinity. The overlapped conveyance detection prohibition area 40 may be, for example, a hatched band-like area having a prescribed width cross to the conveyance direction. In the label sheet 14 containing multiple labels, the labels are generally arranged longitudinally and laterally, and the IC tag 12 is arranged in a direction cross to the conveyance direction. The above band-like overlapped conveyance detection prohibition area 40 is set so that the IC tag 12 arranged in this direction does not influence the overlapped conveyance detection. Here, the width of the overlapped conveyance detection prohibition area 40; i.e., the size in the conveyance direction, is set so as to cover an area in which the overlapped conveyance sensor 28 and controller 30 may perform erroneous detection due to the presence of the IC tag 12, or to cover an area obtained by adding a prescribed margin to the above area. While the overlapped conveyance sensor 28 moves on the label sheet 14 along an overlapped conveyance sensor movement line 42, when the sensor traverses the overlapped conveyance detection prohibition area 40, the controller 30 does not perform overlapped conveyance detection; overlapped conveyance detection is performed by reference to information obtained in the area other than the prohibition area.

The overlapped conveyance detection prohibition area 40 is set by presuming the position of the IC tag 12 in the second and subsequent columns of one piece of label sheet 14 by reference to the positional information of the first column of the IC tag 12 in which the first writing has been performed by the RFID reader/writer 26, and the specifications of the label sheet 14 used herein. The specifications of the label sheet 14 may be inputted by the user using the input unit 32. In this case, the required specification information includes the arrangement interval of the IC tag 12 in the conveyance direction and information on the number of columns of IC tags in one piece of label sheet.

Without using the information from the RFID reader/writer 26, the overlapped conveyance detection prohibition area 40 can also be set by acquiring, as the specifications of the label sheet 14, the position of the IC tag 12 on the label sheet 14, especially information by which the distance between the tip end of the label sheet 14 and each IC tag 12 can be determined.

In the above description, the overlapped conveyance detection prohibition area is set, but there may be set an area in which overlapped conveyance detection is performed. More specifically, an overlapped conveyance detection area is set as a non-hatched part on the label sheet 14 in FIG. 4, and the controller 30 performs overlapped conveyance detection in this area.

Figure 5:
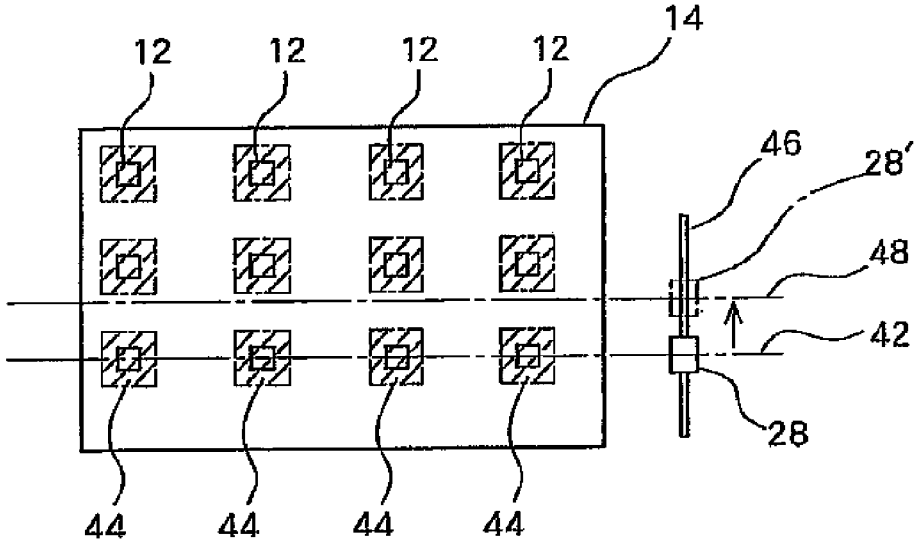
FIG. 5 is a view illustrating another exemplary overlapped conveyance detection prohibition area.

FIG. 5 is a view illustrating an example where the relative position between the overlapped conveyance sensor 28 and the IC tag 12 on the label sheet in a direction cross to the conveyance direction is varied in order to prevent erroneous overlapped conveyance detection. When the acquired sheet information contains information on the position of the IC tag 12 in the direction cross to the conveyance direction, an overlapped conveyance detection prohibition area 44 can be set by reference to this information as not the band-like area illustrated in FIG. 4 but as separate areas for each IC tag 12. More specifically, while the position of the IC tag 12 in the conveyance direction is identified by reference to the information from the RFID reader/writer 26, the position of the IC tag 12 in a direction cross to the conveyance direction is identified by reference to the sheet information. Then, the overlapped conveyance detection prohibition area 44 having a prescribed area is set for each IC tag 12. The overlapped conveyance detection prohibition area 44 is set so as to cover an area in which the overlapped conveyance sensor 28 and controller 30 may perform erroneous detection, or to cover an area obtained by adding a prescribed margin to the above area. The overlapped conveyance sensor 28 is moved in a direction cross to the conveyance direction by an overlapped conveyance sensor movement mechanism 46 so that the ultrasonic wave transmission range of the overlapped conveyance sensor 28 does not overlap with the overlapped conveyance detection prohibition area 44. The movement line 48 of the moved overlapped conveyance sensor 28' on the label sheet does not intersect the overlapped conveyance detection prohibition area 44.

Instead of displacing the overlapped conveyance sensor 28, the label sheet 14 may be displaced in a direction cross to the conveyance direction. For example, side walls are formed in the left and right sides of the conveyance path at an interval longer than the width of the label sheet, and the label sheet 14 is conveyed along any of the side walls, whereby the label sheet 14 can be displaced. The side wall to be used can be selected by varying the skew angle of the label sheet conveyance roller.

Further, multiple overlapped conveyance sensors 28 may be arranged in a direction cross to the conveyance direction, so that the overlapped conveyance detection is performed by selecting, from among the sensors, one which does not traverse the overlapped conveyance detection prohibition area 44, and thereby varying the position to which the ultrasonic wave is to be transmitted. In this case, the interval between the sensors is set smaller than the communication interference distance of RFID. When two IC tags 12 are positioned close to each other, interference occurs, disabling communication. Accordingly, when multiple IC tags 12 are mounted on one piece of label sheet 14, they must be arranged at an interval longer than the above distance. When two overlapped conveyance sensors 28 are arranged at an interval shorter than the interference distance, at least one overlapped conveyance sensor 28 lies in a position where the sensor is not influenced by the IC tag 12.

As described above, the example in which the relative positional relationship in a direction cross to the conveyance direction between the label sheet 14 and overlapped conveyance sensor 28 is varied may be applied to a case where the IC tags 12 are aligned in the conveyance direction on the label sheet 14. Also, in the above description, an overlapped conveyance detection prohibition area is set, but an area where the overlapped conveyance detection is performed may be set. More specifically, in FIG. 5, the non-hatched part on the label sheet 14 may be set as an overlapped conveyance detection area, so that overlapped conveyance detection is performed in this area.

Figure 6:
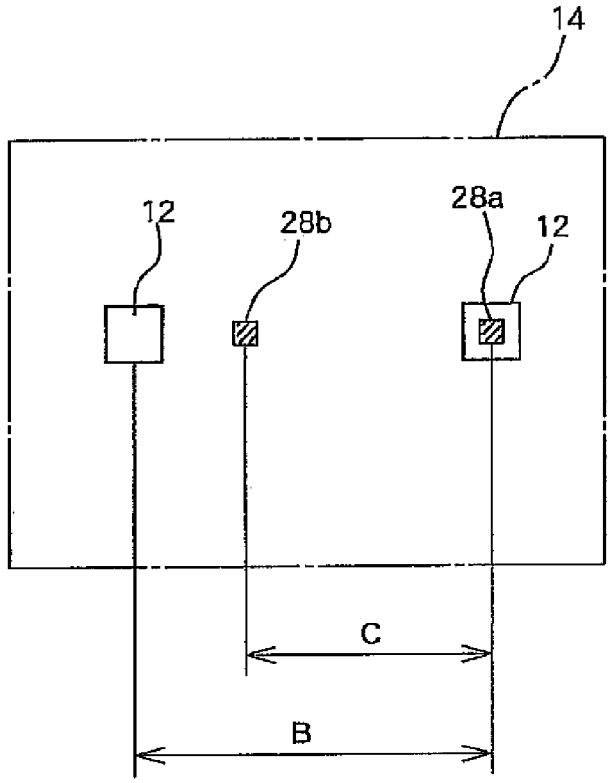
FIG. 6 is a view illustrating a positional relationship between an IC tag and an overlapped conveyance sensor according to another exemplary embodiment.

FIG. 6 is a view for explaining an example where multiple overlapped conveyance sensors are provided. In this example, as the overlapped conveyance sensor, two overlapped conveyance sensors 28*a* and 28*b* are provided. The hatched areas in FIG. 6 are respective overlapped conveyance detection areas of the overlapped conveyance sensors at a given time. More specifically, these areas are parts in which a line connecting the ultrasonic wave transmitter and receiver 36 and 38 intersects with the label sheet 14 on the sheet conveyance path. When two IC tags 12 are positioned close to each other, interference occurs, disabling communication. Accordingly, when multiple IC tags 12 are mounted on one piece of label sheet 14, they must be arranged at an interval longer than the above distance. The two IC tags 12 of FIG. 6 are arranged at interval B slightly longer than the interference distance. In contrast, the overlapped conveyance sensors 28*a* and 28*b* are arranged at interval C shorter than the interference distance. When the two overlapped conveyance sensors are arranged in this manner, erroneous detection caused by the influence of the IC tag 12 does not occur simultaneously in the two sensors. Accordingly, when only one of the two overlapped conveyance sensors 28*a* and 28*b* detects overlapped conveyance, this is not determined as overlapped conveyance; when the two sensors simultaneously detect overlapped conveyance, this is determined as overlapped conveyance. The two overlapped conveyance sensors 28 may be arranged distant from each other in the conveyance direction, or may be arranged in a direction cross to the conveyance direction.

Figure 7:
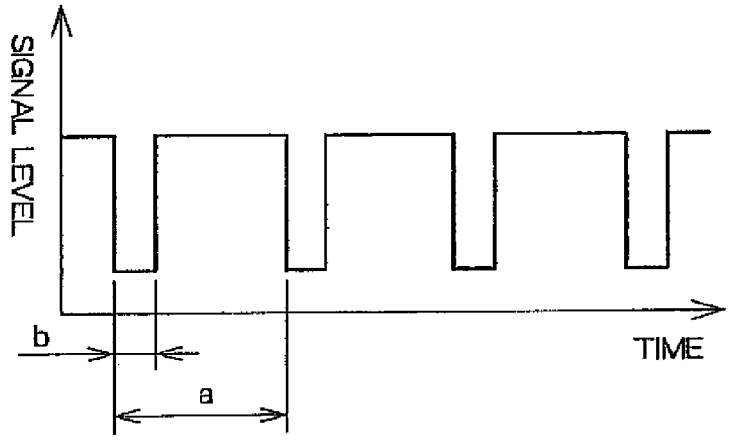
FIG. 7 is a view illustrating an output signal waveform of the overlapped conveyance sensor according to another exemplary embodiment.

FIG. 7 is a view illustrating an output signal waveform of the overlapped conveyance sensor 28. When the overlapped conveyance sensor 28 moves along the overlapped conveyance sensor movement line 42 illustrated in FIG. 4, the output signal level lowers due to the influence of the IC tag 12 which traverses the movement line. As illustrated in FIG. 4, when the IC tags 12 are aligned at a prescribed interval in the conveyance direction, and when the position of the overlapped conveyance sensor 28 agrees with that of the IC tag 12, the lowering of signal level occurs, as illustrated in FIG. 7, at a given interval corresponding to the arrangement interval of the IC tag 12. From this feature of the waveform, the controller 30 determines whether or not there has occurred erroneous detection of overlapped conveyance caused by the influence of the IC tag 12.

This feature of the waveform is represented by the lowering of signal level at interval a corresponding to the arrangement interval of the IC tag 12. Information on the position of the IC tag 12 is acquired as the sheet specification, so that erroneous detection of overlapped conveyance caused by the influence of the IC tag 12 is determined by reference to the relationship between the above information and the waveform actually obtained. Usually, the IC tags 12 are arranged at a uniform interval, so that when the lowering of signal level occurs at a uniform interval in the waveform, this may be determined as erroneous detection of overlapped conveyance. Also, erroneous detection of overlapped conveyance may be determined by reference to width b in which the signal level lowers. The lowering of signal level corresponding to the influence of the IC tag 12 is limited to a given area around the IC tag 12, so that width b corresponds to this area; erroneous detection of overlapped conveyance caused by the influence of the IC tag 12 may be determined from repeated lowering of signal level having width b. Further, erroneous detection of overlapped conveyance may be determined by reference to a combination of signal level lowering interval a and lowering width b. More specifically, when both interval a and interval width b agree with values indicating erroneous detection of overlapped conveyance caused by the influence of the IC tag 12, erroneous detection is determined to have occurred.

What is claimed is:

1. An overlapped conveyance detection apparatus that detects overlapped conveyance of a printing sheet incorporating an IC tag, the apparatus comprising:

an overlapped conveyance detection unit that transmits and receives ultrasonic waves to/from the printing sheet and detects overlapped conveyance of the printing sheet by reference to an ultrasonic wave signal;

a tag position information acquisition unit that acquires the position of at least one IC tag on the printing sheet; and a detection prohibition area determination unit that determines, from the acquired IC tag position, an area on the printing sheet in which overlapped conveyance detection is prohibited.

2. The overlapped conveyance detection apparatus according to claim 1, wherein the tag position information acquisition unit includes a communication unit that communicates with the IC tag, and thereby acquires the position of the IC tag by reference to a communication state.

3. The overlapped conveyance detection apparatus according to claim 2, wherein:

the overlapped conveyance detection apparatus is used for a printing sheet incorporating a plurality of IC tags; and the tag position information acquisition unit further includes a sheet specification acquisition unit that acquires a sheet specification including information on an interval between the IC tags, and thereby acquires the position of the IC tag by reference to the IC tag position acquired from the communication state and the IC tag interval corresponding to the sheet specification.

4. The overlapped conveyance detection apparatus according to claim 1, wherein the tag position information acquisition unit includes a sheet specification acquisition unit that acquires a sheet specification including information on the position of the IC tag on the printing sheet, and thereby acquires the position of the IC tag by reference to the sheet specification.

5. The overlapped conveyance detection apparatus according to claim 1, wherein the overlapped conveyance detection unit includes a transmission position varying section that varies, in a direction cross to a sheet conveyance direction, that position on the printing sheet to which the ultrasonic waves are to be transmitted, so that overlapped conveyance detection is performed in an area other than the area in which overlapped conveyance detection is prohibited.

6. An overlapped conveyance detection apparatus that detects overlapped conveyance of a printing sheet incorporating an IC tag, the apparatus comprising:

an overlapped conveyance detection unit that transmits and receives ultrasonic waves to/from the printing sheet and detects overlapped conveyance of the printing sheet by reference to an ultrasonic wave signal;

a tag position information acquisition unit that acquires the position of at least one IC tag on the printing sheet; and a detection area determination unit that determines, by reference to the acquired IC tag position, an area on the printing sheet in which overlapped conveyance detection is performed.

7. An overlapped conveyance detection method that detects overlapped conveyance of a printing sheet incorporating an IC tag, the method comprising:

acquiring the position of at least one IC tag on the printing sheet;

determining, by reference to the acquired IC tag position, an area on the printing sheet in which overlapped conveyance detection is prohibited; and transmitting and receiving ultrasonic waves to/from the printing sheet and detecting overlapped conveyance of the printing sheet by reference to an ultrasonic wave signal in an area other than the area in which overlapped conveyance detection is prohibited.

8. An overlapped conveyance detection method that detects overlapped conveyance of a printing sheet incorporating an IC tag, the method comprising:

acquiring the position of at least one IC tag on the printing sheet;

determining, by reference to the acquired IC tag position, an area on the printing sheet in which overlapped conveyance detection is performed; and transmitting and receiving ultrasonic waves to/from the printing sheet and detecting overlapped conveyance of the printing sheet by reference to an ultrasonic wave signal in the area in which overlapped conveyance detection is performed.

* * * * *